US012473724B2

(12) United States Patent
Lechner et al.

(10) Patent No.: US 12,473,724 B2
(45) Date of Patent: Nov. 18, 2025

(54) MOUNTING DEVICE

(71) Applicant: GEBERIT INTERNATIONAL AG, Jona (CH)

(72) Inventors: Manuel Lechner, Kaltbrunn (CH); Lukas Ramseier, Jona (CH)

(73) Assignee: GEBERIT INTERNATIONAL AG, Jona (CH)

( * ) Notice: Subject to any disclaimer, the term of this patent is extended or adjusted under 35 U.S.C. 154(b) by 248 days.

(21) Appl. No.: 18/038,895

(22) PCT Filed: Dec. 1, 2021

(86) PCT No.: PCT/EP2021/083684
§ 371 (c)(1),
(2) Date: May 25, 2023

(87) PCT Pub. No.: WO2022/122492
PCT Pub. Date: Jun. 16, 2022

(65) Prior Publication Data

US 2024/0093471 A1 Mar. 21, 2024

(30) Foreign Application Priority Data

Dec. 10, 2020 (EP) ..... 20213092
Dec. 10, 2020 (EP) ..... 20213096
Dec. 10, 2020 (EP) ..... 20213098

(51) Int. Cl.
*E03C 1/326* (2006.01)
*E03D 11/14* (2006.01)

(52) U.S. Cl.
CPC ..... *E03C 1/326* (2013.01); *E03D 11/143* (2013.01)

(58) Field of Classification Search
CPC ..... E03C 1/326; E03D 11/143
USPC ..... 4/643, 645; 248/132, 161, 157, 274.1, 248/327
See application file for complete search history.

(56) References Cited

FOREIGN PATENT DOCUMENTS

| | | |
|---|---|---|
| DE | 26 39 018 A1 | 3/1978 |
| DE | 2809135 A1 | 9/1979 |
| DE | 34 10 499 A1 | 8/1985 |
| DE | 297 04 549 U1 | 6/1997 |
| DE | 203 04 749 U1 | 5/2003 |

(Continued)

OTHER PUBLICATIONS

International Search Report of PCT/EP2021/083685 dated Mar. 14, 2022 [PCT/ISA/210].

(Continued)

*Primary Examiner* — Lori L Baker
(74) *Attorney, Agent, or Firm* — Sughrue Mion, PLLC

(57) ABSTRACT

A mounting device for fastening at least one plumbing appliance having two supports, which extend at a distance from one another along a central axis, and a crosspiece element, which connects the two supports and has at least one fastening element. The crosspiece element has a lower web, a front web and an upper web. The lower web projects in an angularly inclined manner at an angle from a lower edge of the front web, and the upper web projects in an angularly inclined manner at an angle from an upper edge of the front web. The at least one fastening element is accessible through at least one opening in the front web, and the ends of at least one of the webs are each connected to the supports by means of a welded joint.

36 Claims, 13 Drawing Sheets

(56) References Cited

FOREIGN PATENT DOCUMENTS

| | | | | |
|---|---|---|---|---|
| DE | 10 2013 203 941 | A1 | 9/2014 | |
| EP | 0 731 231 | A1 | 9/1996 | |
| EP | 2 366 838 | A1 | 9/2011 | |
| EP | 2 662 502 | A1 | 11/2013 | |
| EP | 2921719 | A1 | 9/2015 | |
| EP | 3067477 | A1 * | 9/2016 | ..... E03D 11/143 |
| EP | 3 470 587 | A1 | 4/2019 | |
| EP | 3093404 | B1 * | 9/2019 | ..... E03C 1/057 |
| EP | 3 670 772 | A1 | 6/2020 | |
| RU | 21790 | U1 | 2/2002 | |
| WO | 2015/180963 | A1 | 12/2015 | |

OTHER PUBLICATIONS

International Search Report for PCT/EP2021/083683 dated Mar. 18, 2022 [PCT/ISA/210].
Written Opinion issued Mar. 14, 2022 in Application No. PCT/EP2021/083685.
Written Opinion issued Mar. 18, 2022 in Application No. PCT/EP2021/083683.
International Search Report for PCT/EP2021/083684 dated Mar. 14, 2022.
Written Opinion for PCT/EP2021/083684 dated Mar. 14, 2022.

* cited by examiner

MOUNTING DEVICE

This Application is a National Stage of International Application No. PCT/EP2021/083684 filed Dec. 1, 2021, claiming priority based on European Patent Application No. 20213096.9 filed Dec. 10, 2020, European Patent Application No. 20213098.5 filed Dec. 10, 2020, European Patent Application No. 20213092.8 filed Dec. 10, 2020.

TECHNICAL FIELD

The present invention relates to a mounting device for fastening at least one plumbing appliance in accordance with the preamble of claim 1.

PRIOR ART

Mounting devices for fastening plumbing appliances are known from the prior art. Mounting devices of this type are permanently installed behind a false wall and serve for the mounting of plumbing appliances, such as cisterns, toilet bowls, urinals, fittings, washbasins, control elements, electrical elements, etc. For example, EP 2 662 502 discloses such a mounting device.

Although very good results are achieved with the mounting devices from the prior art during installation in a building, it is desirable on the part of the manufacturer to provide a mounting device which can be used in a more flexible way.

SUMMARY OF THE INVENTION

Proceeding from this prior art, the underlying object of the invention is to specify a mounting device for fastening at least one plumbing appliance which overcomes the disadvantages of the prior art. In particular, it is an object of the present invention to specify a mounting device for fastening at least one plumbing appliance which can be used in a more flexible way.

This object is achieved by the subject matter of claim 1. Accordingly, a mounting device for fastening at least one plumbing appliance comprises two supports, which extend at a distance from one another along a central axis, and a crosspiece element, which is arranged between the supports, connects the two supports and has at least one fastening element. The crosspiece element has a lower web, a front web and an upper web, wherein the lower web projects in an angularly inclined manner at an angle $\alpha$ from a lower edge of the front web, and wherein the upper web projects in an angularly inclined manner at an angle $\beta$ from an upper edge of the front web. The at least one fastening element is accessible through at least one opening in the front web. The ends of at least one of the webs are each connected to the supports by means of a welded joint. This means that the ends of at least one of the webs selected from the group comprising lower web, front web and upper web are each connected to the supports by means of a welded joint. As a particular preference, the ends of the lower web and the upper web are each connected to the supports by means of a welded joint. In another preferred variant, the ends of the lower web, the front web and the upper web are each connected to the supports by means of a welded joint.

As a result of this design of the crosspiece, the front web can be designed with a low height, thus allowing the space above the crosspiece, when viewed in the installation position, to be used for the installation of further elements, which serve to supply the plumbing appliance. Such elements are, for example, further plumbing elements, electrical sockets, control devices, fans for odor extraction, etc. To this extent, more flexible use is made possible.

The front web has a front face which, in the installation position, is oriented toward the plumbing appliance. In this case, the plumbing appliance rests on the front face via a false wall. The false wall can be designed in various ways. When viewed in the installation position, the crosspiece element is open toward the rear and closed toward the front by the front face.

By virtue of the arrangement of the lower web and of the upper web, which project from the front web, it is possible to create a C profile.

Said welded joint between the crosspiece element and the two supports can extend along the full length of the lower web, the front web or the upper web. However, the welded joint can also extend only over a partial region of said length.

The at least one fastening element can be designed in various ways. For example, as a threaded opening directly in the crosspiece element, as openings in the crosspiece element, as nuts behind an opening in the crosspiece element, or as a separate fastening part behind an opening in the crosspiece element. As a preferred option, a threaded rod can be connected to the at least one fastening element. That is to say that the at least one fastening element is, for example, a receptacle for a threaded rod. Said fastening part is preferably securely connected to the crosspiece element and is preferably situated behind the front web.

An upper free end of the upper web, which lies opposite the upper edge of the front web, preferably lies at a vertical distance of 40 to 90 millimeters from the lower web.

The vertical distance is the distance in a direction that extends parallel to the front face of the front web. In the installation position, the vertical distance extends in the vertical direction.

The selection of the vertical distance in this region has the advantage that the crosspiece, seen above the fastening element, does not extend very far. This creates space for the installation of the abovementioned further elements.

A reference plane preferably extends at right angles to the central axes of the two supports and centrally through the at least one fastening element. An upper free end of the upper web, which lies opposite the upper edge of the front web, lies at a vertical distance of 35 to 60 millimeters from the reference plane.

The angle $\beta$ between the front web and the upper web is preferably in the range of from 100° to 150°. The angular inclination between the front web and the upper web increases the stability of the crosspiece element.

The angle $\alpha$ between the front web and the lower web is preferably in the range of from 80' to 100', preferably 90°.

The upper web and/or the lower web preferably have/has an end section projecting parallel to the front web. The end section provides the abovementioned free end of the upper web. The projecting connection section further increases the stability of the crosspiece element.

The front surfaces of the supports preferably span a front plane and the rear surfaces of the supports span a rear plane. The crosspiece element preferably lies in such a way that the front face of the front web lies in said front plane. Furthermore, the upper web extends from the front plane to the back plane. If the optional connection section is present, its rear side lies in said rear plane. The lower web extends from the front plane to at least the rear plane.

The mounting device furthermore preferably comprises a wall element which is formed separately from the mounting device and which, when viewed in the installation position, can be arranged above the crosspiece element, wherein the wall element is preferably in contact with the crosspiece element. The wall element can be used as an option, depending on the installation situation.

The wall element is preferably made of plastic or metal. As regards mounting, the wall element can be mounted in various ways. The wall element is preferably detachably mounted. For example, by way of a latching and/or snap connection. The wall element can be fitted onto the upper web, for example. As a particular preference, the wall element is in contact with the end section of the upper web.

The upper web is preferably designed in such a way khat it serves to support the wall element.

As a particular preference, the wall element is fitted onto the abovementioned connection section.

The wall element preferably has a rear wall and an upper wall. In the installation position, the rear wall preferably extends parallel to the two central axes, and the upper wall preferably extends in an angularly inclined manner at an angles to the rear wall, such that an installation space is created between the upper web, the end section, the rear wall and the upper wall.

The rear wall preferably forms the continuation of the end section.

The installation space serves to accommodate connection elements, such as plumbing appliances, electrical sockets, etc. When viewed in the installation position, the installation space is accessible from the front. The wall element shields the installation space from the rear, which is of great advantage in the case of the insulation flock-filling of a false wall structure in which the mounting device is mounted.

When viewed in the installation position, the installation space is accessible from the front. In other words, the installation space is designed in such a way that the installation space is open toward the front, simplifying the installation of the elements mentioned.

The rear wall of the wall element preferably has a rear side which lies in a rear plane spanned by the rear surfaces of the supports. The upper wall of the wall element preferably extends as far as a front plane spanned by the front faces of the supports.

The crosspiece element preferably has an interruption through the front web and the upper web. The interruption is used to pass connecting lines through.

The wall element preferably has an aperture which is arranged in such a way that the interruption in the crosspiece element continues upward.

In a first preferred embodiment, the crosspiece element, with the lower web, the front web and the upper web, is provided by an integral profile. In addition, the mounting device comprises a further crosspiece, which lies below the crosspiece element in the installation position, wherein the further crosspiece provides a supporting wall on which the plumbing appliance can be supported.

In this embodiment, the crosspiece element is subjected to tensile stress by the plumbing appliance and the further crosspiece is subjected to compressive stress. The further crosspiece is likewise connected to the two supports. The crosspiece element, the further crosspiece and the two supports are preferably made of metal and are connected materially to the support in a materially bonded manner, in particular by means of a welded joint, and/or are connected positively and/or non-positively to the support.

In a second preferred embodiment, the crosspiece element is provided by a front supporting part, having a supporting wall on which a plumbing appliance can be supported, and a rear supporting part, having a rear wall.

The front supporting part and/or the rear supporting part preferably have/has at least one connecting tab, which projects in an angularly inclined manner, in particular at a right angle, from the supporting wall and/or from the rear wall. The two supporting parts can be securely connected to one another via the at least one connecting tab, such that, in the connected state, the supporting wall is spaced apart from the rear wall.

The arrangement of connecting tabs on the two supporting parts results in the advantage that the crosspiece element can be produced in a very simple manner. In particular, complex alignment work is eliminated since the two supporting parts can be positioned relative to one another by the connecting tabs and can then be connected to one another via the connecting tabs.

The expression "can be securely connected" is understood to mean a connection which is mechanically secure. Such a connection can be achieved by means of a materially bonded and/or positive and/or non-positive connection. As a particular preference, the connection is a welded joint.

The spacing of the supporting wall from the rear wall results in the advantage that the crosspiece element can be made available as a hollow body, thereby making it possible to provide a high mechanical stability.

The at least one connecting tab of the front supporting part preferably comes into surface contact with the at least one connecting tab of the rear supporting part. In the connected skate, the connecting tabs of the front supporting park and of the rear supporting part are in surface contact with one another.

The surface contact between the two connecting tabs results in the advantage of the accurate positioning of the two supporting parts relative to one another. In addition, a supporting effect between the two supporting parts occurs via the surface contact. Furthermore, said secure connection can be placed in the region of the surface contact.

In one variant, the at least one connecting tab of the one supporting part is preferably designed to be shorter than the at least one connecting tab of the other supporting part. At least one weld is provided on the end face of the shorter connecting tab and the surface of the longer connecting tab. As a result of the shorter design of the one connecting tab, space is created for a weld. In particular, the weld comes to lie in the region of the surface of the longer connecting tab, which has the advantage that the weld comes to lie at a location which is well suited for a weld.

In another variant, the at least one connecting tab of the one supporting part is preferably designed to be the same length as the at least one connecting tab of the other supporting part. At least one weld is provided on the end face of one connecting tab and the surface of the other connecting tab. If the connecting tabs are of the same length, the welded joint likewise comes to rest on the surface of the other connecting tab.

The supporting wall, the rear wall, the connecting tabs and the supports preferably define a hollow body having a cavity, wherein said weld lies outside the cavity. This provides good accessibility for the production of the weld. In particular, in the connected state, said shorter connecting tab lies outside the cavity.

The at least one connecting tab of the front supporting part preferably abuts the inner surface of the rear supporting part facing the front supporting part, thereby defining the distance between the front supporting part and the rear supporting part. Alternatively or equally, the at least one connecting tab of the rear supporting part abuts the inner surface of the front supporting part facing the rear supporting part, thereby defining the distance between the front supporting part and the rear supporting part.

The abutment of the connecting tabs against the corresponding inner surface results in the advantage that there is no need to provide additional elements to define the distance between the two supporting pads. In this respect, the production or mounting of the crosspiece element is greatly simplified.

The front supporting part is preferably formed integrally with the supporting wall and the at least one connecting tab. Likewise, the rear supporting part is formed integrally with the rear wall and connecting tab.

The two supporting parts are preferably produced from a metal sheet, wherein the connecting tabs are bent away from the supporting wall or rear wall. Before the bending operation, the metal sheet is brought to the required shape and dimension in a blanking operation or a punching operation.

The crosspiece element preferably comprises a recess, which provides a free intermediate space through the crosspiece element, through which an outflow pipe can be passed, wherein the recess in the supporting parts is formed by a cutout in the supporting wall and the rear wall.

The recess preferably extends from below into the crosspiece element and is designed to be open toward the bottom. The recess can have different shapes. As a particular preference, the recess is rectangular. Other shapes, such as, for example, V-shaped or trapezoidal, are also conceivable. As a particular preference, the recess has straight lateral edges, so that a connecting tab can be bent away from the supporting wall or the rear wall.

Preferably, connecting tabs each extend along the lateral edges situated opposite with respect to the cutout, and further connecting tabs extend along the lateral edges which extend from the cutout to the support.

The connecting tabs preferably each extend over the entire length of the respective lateral edge from which they project.

The supporting wall and the rear wall are preferably connected to the respective support via their lateral edge facing the support, wherein the connecting tabs run along free lateral edges which are not connected to the support.

The connecting tabs are preferably connected to one another by means of a welded joint. The crosspiece element is preferably made of metal and is connected to the support in a materially bonded manner, in particular by means of a welded joint, and/or is connected positively and/or non-positively to the support. Alternatively, the crosspiece element is made of plastic and is connected positively and/or non-positively to the supports.

The supporting section preferably extends substantially downward with respect to the at least one fastening element in the installation position.

The maximum extent of the crosspiece element, when viewed in the direction of the longitudinal axis of the supports, is preferably in the range of from 150 mm to 500 mm, in particular in the range of from 200 mm to 400 mm, the extent between 275 mm and 350 mm being particularly preferred.

At least one, in particular each, of the supports is preferably connected to a supporting foot, via which supporting foot the mounting device rests on a floor, wherein the supporting foot is preferably designed to be movable relative to the support and lockable relative to the support.

An arrangement comprises a mounting device according to the above description and a plumbing appliance mounted on the mounting device and having a supporting surface, wherein the supporting surface of the plumbing appliance overlaps parts of the supporting wall of the front supporting part.

Further embodiments are laid down in the dependent claims.

BRIEF DESCRIPTION OF THE DRAWINGS

Preferred embodiments of the invention are described in the following with reference to the drawings, which are only for the purpose of illustration and should not be interpreted as restrictive. In the drawings.

DESCRIPTION OF PREFERRED EMBODIMENTS

Figure 1:
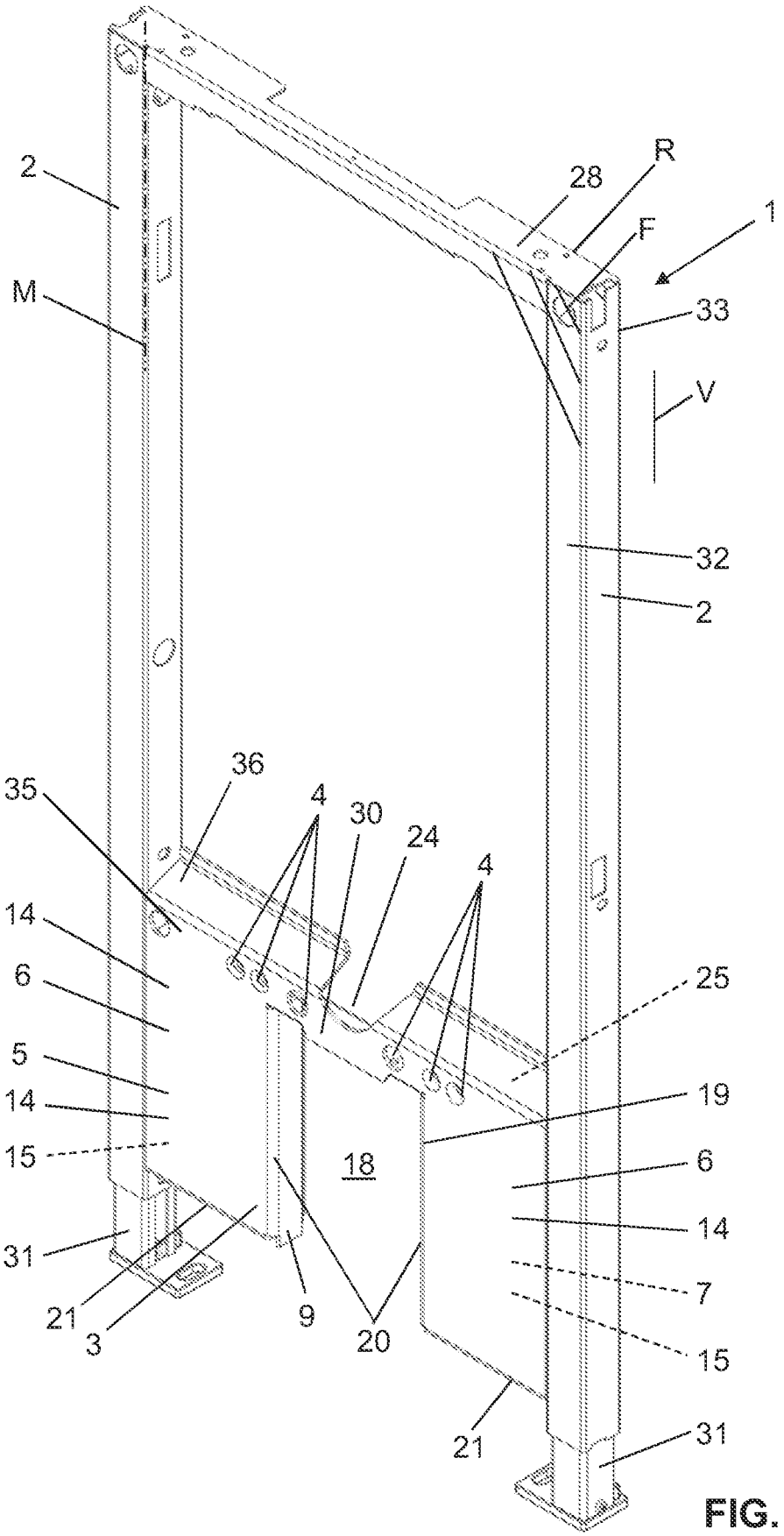
FIG. 1 shows a perspective view of a mounting device according to one embodiment of the present invention from the front.

FIGS. 1 to 10 show a mounting device 1 according to one embodiment, and FIGS. 11 to 14 show a mounting device 1 according to a further embodiment. Identical parts are provided with the same reference signs in each case. The mounting device 1 according to both embodiments serves for fastening at least one plumbing appliance.

In the embodiments shown, the mounting device 1 comprises two supports 2, which extend at a distance from one another along a central axis M, and a crosspiece element 3, which is arranged between the supports 2, connects the two supports 2 and has at least one fastening element 4. The plumbing appliance is fastened to the crosspiece element 3 on the fastening element 4. In the embodiment shown, a plurality of fastening elements 4 is arranged next to one another. In the installation position, the two supports 2 typically run in the vertical V, that is to say in the vertical direction. At the top, the two supports 2 are connected to a crosspiece 28.

In both embodiments, the crosspiece element 3 has a lower web 34, a front web 35 and an upper web 36. The crosspiece element 3 is configured differently in the two embodiments. In the first embodiment, an arrangement is shown in which the crosspiece element 3 is provided by a front supporting part 5 and a rear supporting part 7. In the further embodiment, an arrangement is shown in which the crosspiece element 3 is designed as a profile element.

The front web 35 has a front face which, in the installation position, is oriented vertically. The front web extends from one support 2 to the other support 2 completely across the intermediate space between the two supports 2.

The lower web 34 projects in an angularly inclined manner at an angle $\alpha$ from a lower edge 37 of the front web 35. The angle $\alpha$ is between 80° and 100°, in particular 90°.

The upper web 36 projects in an angularly inclined manner at an angle $\beta$ from an upper edge 38 of the front web 35. The angle $\beta$ is preferably in the range of from 100° to 150°.

With respect to the at least one fastening element 4, the front web 35 and the upper web 36 are designed in such a way that the crosspiece element 3 extends upward only to a comparatively small extent. This creates an installation space which is accessible from the front in the installation position. This installation space bears the reference sign 45.

An upper free end 40 of the upper web 36, which lies opposite the upper edge 38 of the front web 35, preferably lies at a vertical distance A1 of 50 to 90 millimeters from the lower web 34. The vertical distance A1 is the distance at right angles to the surface of the lower web 34.

A vertical distance A2 from a reference plane RE to the upper free end 40 of the upper web 36 is preferably in a range of from 35 to 60 millimeters. The reference plane RE extends at right angles to the central axes M of the two supports 2 and centrally through the at least one fastening element 4.

The at least one fastening element 4 is accessible through at least one opening 39 in the front web 35. In the embodiment shown, a plurality of fastening elements 4 is arranged, said elements typically serving to receive threaded rods. The fastening elements 4 can be integrally formed on the crosspiece element 3 or can be connected to the crosspiece element 3 as additional elements.

In both embodiments, the ends of the lower web 34 and/or the front web 35 and/or the upper web 36 are each connected to the supports 2 by means of a welded joint. The welded joint preferably extends over the entire length of the edge of the lower web 34, of the front web 35 and of the upper web 36 which is associated with the support 2. However, the welded joint can also be interrupted in some section or sections.

In the embodiments shown, the upper web 36 further has an end section 41. In this case, the upper web 36 is oriented parallel to the front web and forms the free end of the upper web 36.

The front surface 32 of the supports 2 spans a front plane F and the rear surface 33 of the supports 2 spans a rear plane R. In both embodiments, the front web 35 lies with its front face in the front plane F. The upper web 36 extends from the front plane F up to the rear plane R. The end section 41 lies with its rear side in the rear plane R. The lower web 34 preferably likewise extends between the front plane F and the rear plane R. The lower web 34 can also extend rearward through the rear plane R.

According to both embodiments, the mounting device 1 further has an optional wall element 42. Here, the wall element 42 is formed separately from the mounting device 1 and can be connected to the mounting device 1. The wall element 42 serves essentially to shield the installation space above the crosspiece element 3 with respect to the rear. This ensures that during the installation process no dirk, insulation flock, mortar, etc. can pass from behind into the installation space above the crosspiece element 3.

The wall element 42 is preferably secured on the crosspiece element 3. As a particular preference, the upper web 36 is designed in such a way that it serves to support the wall element 42. This means that the wall element 42 can be brought into connection with the upper web 36.

The wall element 42 preferably extends from the one support 2 to the other support 2.

The wall element 42 preferably has a rear wall 43 and an upper wall 44. The rear wall 43 runs parallel to the central axis M and the upper wall 44 extends in an angularly inclined manner at an angle $\delta$ to the rear wall 43. Here, the rear wall 43 and the upper wall 44 extend in such a way that an installation space 45 is created between the upper web 36, the end section 41 the rear wall 43 and the upper wall 44.

The rear wall 43 has a rear side which lies in a rear plane R spanned by the rear surfaces 33 of the supports 2. The upper wall 44 extends as far as a front plane F spanned by the front surfaces 32 of the supports 2.

In both embodiments, the crosspiece element 3 has an interruption 24, and the wall element 42 has an aperture 46. The interruption 24 and the aperture 46 are each arranged in such a way that the interruption 24 continues into the aperture 46. The interruption 24 and the aperture 46 serve, for example, for the passage of a flushing pipe or an electric lead or some other element.

In both embodiments, the crosspiece element 3 is preferably produced from a steel sheet. In particular by a punching operation and a forming operation following the punching operation. The crosspiece element 3 is connected to the supports 2 by means of a welded joint, wherein the lateral edges 27, which face the supports 2, are correspondingly welded to the supports 2.

In both embodiments, the mounting device 1 further comprises two supporting feet 31, which are mounted telescopically in the support 2. The supporting feet 31 can be displaced in their position relative to the support 2 and can be locked when the height has been set.

In the embodiments shown, the supports 2 are designed as hollow profiles. In this case, hollow profiles have a quadrilateral, in particular a square cross section.

In the following, details of the embodiment according to FIGS. 1 to 10 will now be described.

As explained above, the crosspiece element according to this embodiment is formed by a front supporting part 5 and a rear supporting part 7. The front web 35 and the upper web 36 are formed on the front supporting part 5. The lower web 34 is formed on the rear supporting part 7. When the two supporting parts 5, 7 are assembled, the lower web 34 comes into contact with the front web 35. A supporting wall 6 adjoins the front web 35 at the bottom. In this case, the front web 35 and the supporting wall 6 lie in the same plane and are formed integrally with one another.

Figure 2:
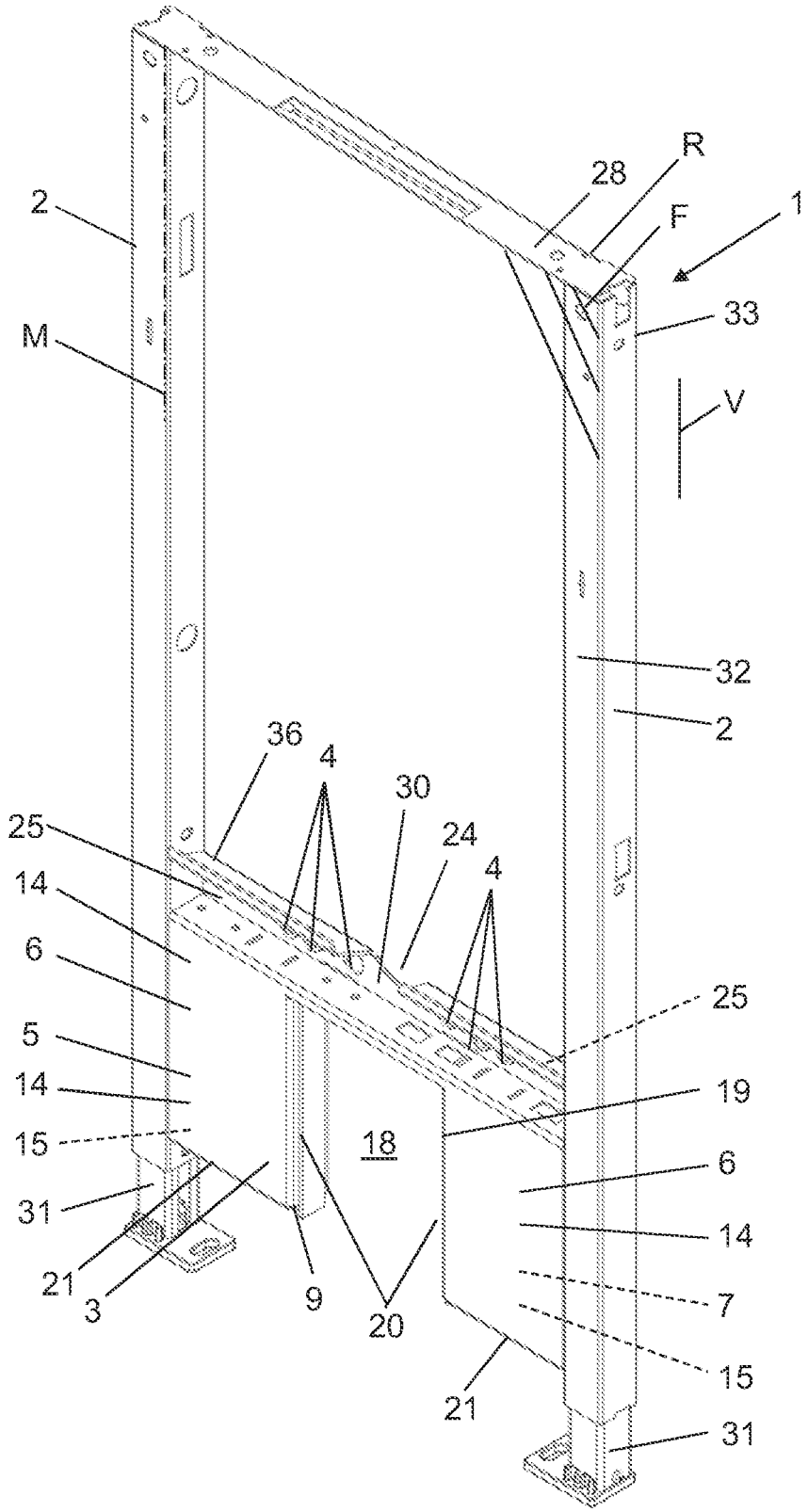
FIG. 2 shows a perspective view of the mounting device according to FIG. 1 from the rear.
Figure 3:
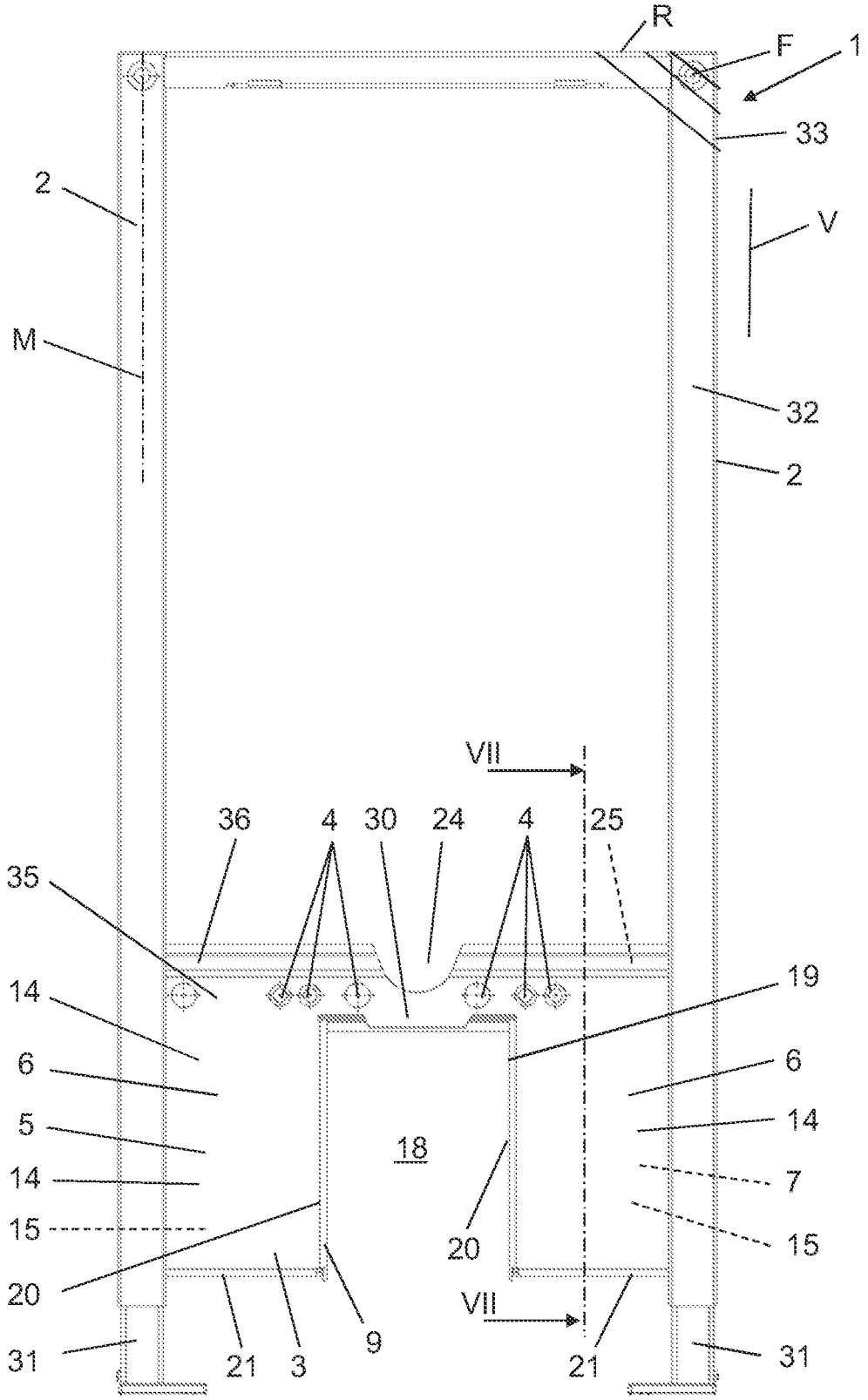
FIG. 3 shows a front view of the mounting device according to FIG. 1 from the front.

FIGS. 1 and 2 show the mounting device in perspective from the front and from the rear. FIG. 3 shows a view from the front. In the embodiment shown, the crosspiece element 3 has a recess 18, through which, for example, a waste pipe can be guided. The width of the recess 18, when viewed transversely to the central axis M of the supports 2, corresponds in the example shown to approximately one third of the total width of the crosspiece element 3. The crosspiece element 3 or the front supporting part 5 and the rear supporting part 7 extend to the left and right of the recess 18. In other words, the recess 18 extends from a region which is below and opposite the at least one fastening element 4 into the crosspiece element 3. When viewed in the installation position, the recess 18 extends from below into the crosspiece element 3 and is designed to be open toward the bottom.

Figure 4:
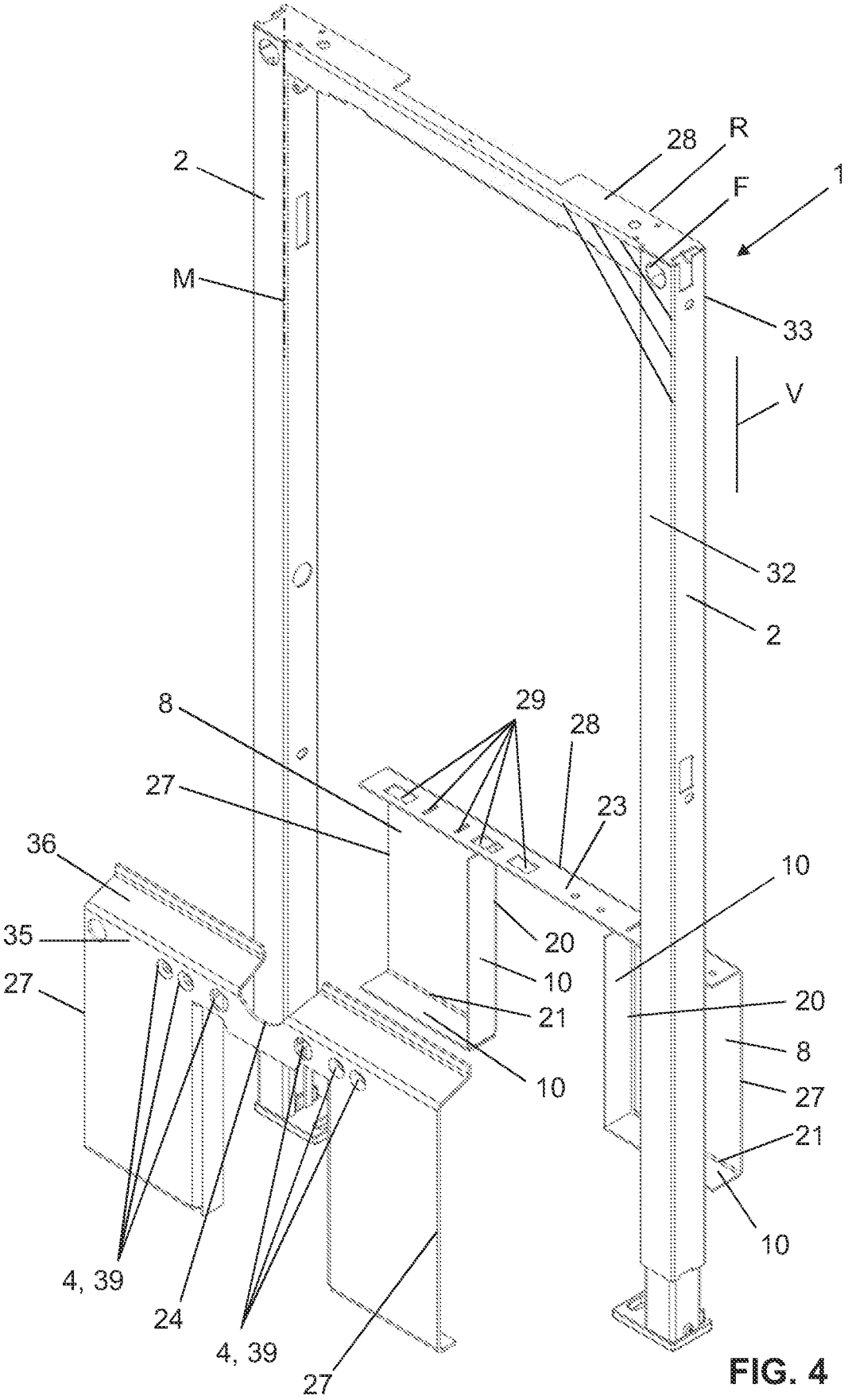
FIG. 4 shows an exploded illustration of the mounting device according to FIG. 1.

FIG. 4 then shows an exploded illustration of the mounting device 1. Here, the crosspiece element 3 is shown before the actual mounting and connection to the support 2. The crosspiece element 3 is provided by the front supporting part 5 with a supporting wall 6 and by the rear supporting part 7 with a rear wall 8. The plumbing appliance can be correspondingly supported on the supporting wall 6. In the embodiment shown, the at least one fastening element 4 lies above the supporting wall 6 when viewed in the installation position. That is to say that the at least one fastening element 4 is subjected to tensile stress when the plumbing appliance is mounted and that the supporting wall 6 or the crosspiece element 3 is subjected to compressive stress.

In the embodiment shown, the front supporting part 5 and the rear supporting part 7 have at least one connecting tab 9, 10. The connecting tabs 9, 10 project at right angles from the supporting wall 6 and the rear wall 8. Other angles are also possible. The two supporting parts 5, 7 are formed integrally. That is to say that the connecting tabs 9, 10 are arranged integrally on the supporting wall 6 and the rear wall 8, respectively.

The two supporting parts 5, 6 can be securely connected to one another via the at least one connecting tab 9, 10. In this case, the connection is such that, in the connected state, the supporting wall 6 lies at a distance from the rear wall 8. Starting from FIG. 3, the connection is effected in each case in such a way that the two supporting parts 5, 7 are moved toward one another until the two supporting parts 5, 6 are correspondingly positioned and can be connected via the at least one connecting tab 9, 10. The connection between the two connecting tabs 9, 10 is preferably a welded joint.

Figure 5:
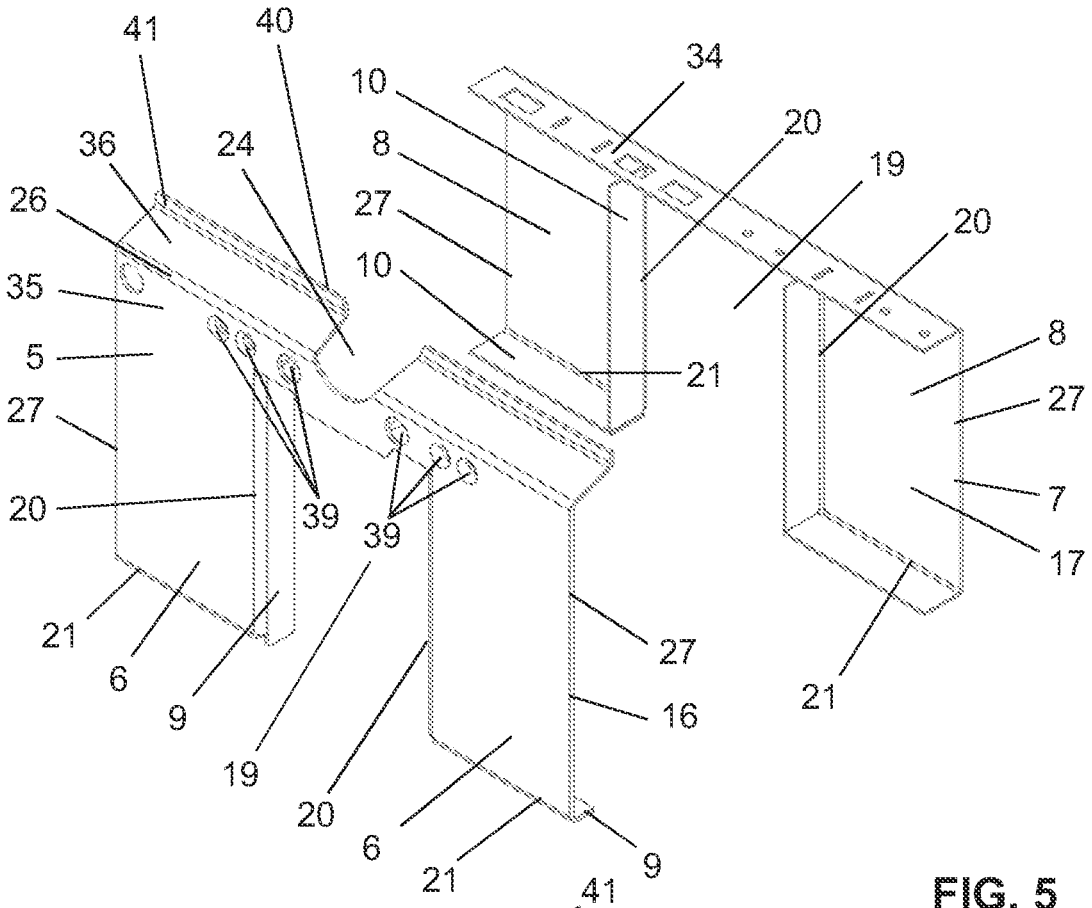
FIG. 5 shows an exploded illustration of a crosspiece element of the mounting device according to FIG. 1 from the front.
Figure 6:
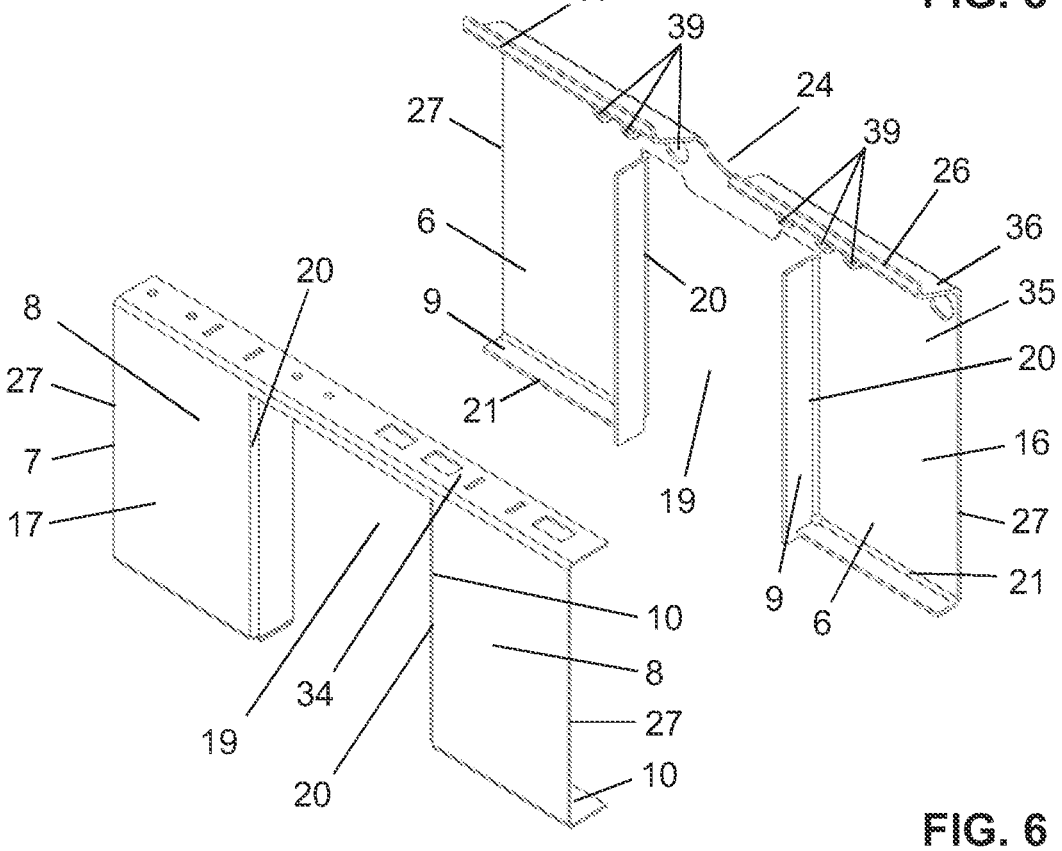
FIG. 6 shows an exploded illustration of a crosspiece element of the mounting device according to FIG. 1 from the rear.
Figure 7:
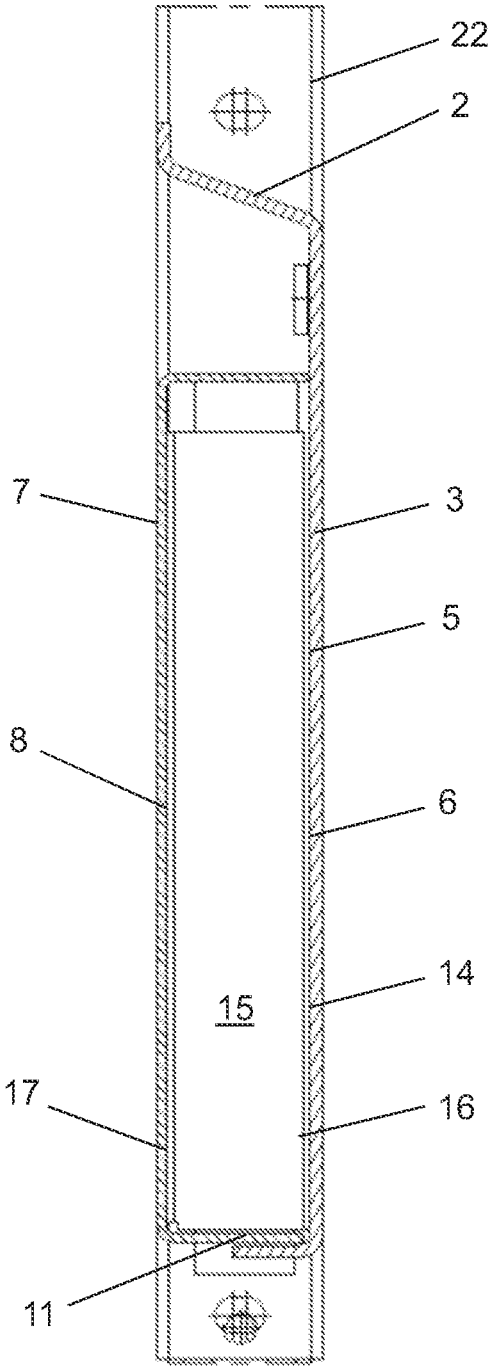
FIG. 7 shows a sectional illustration along section line VII-VII in FIG. 3.
Figure 8:
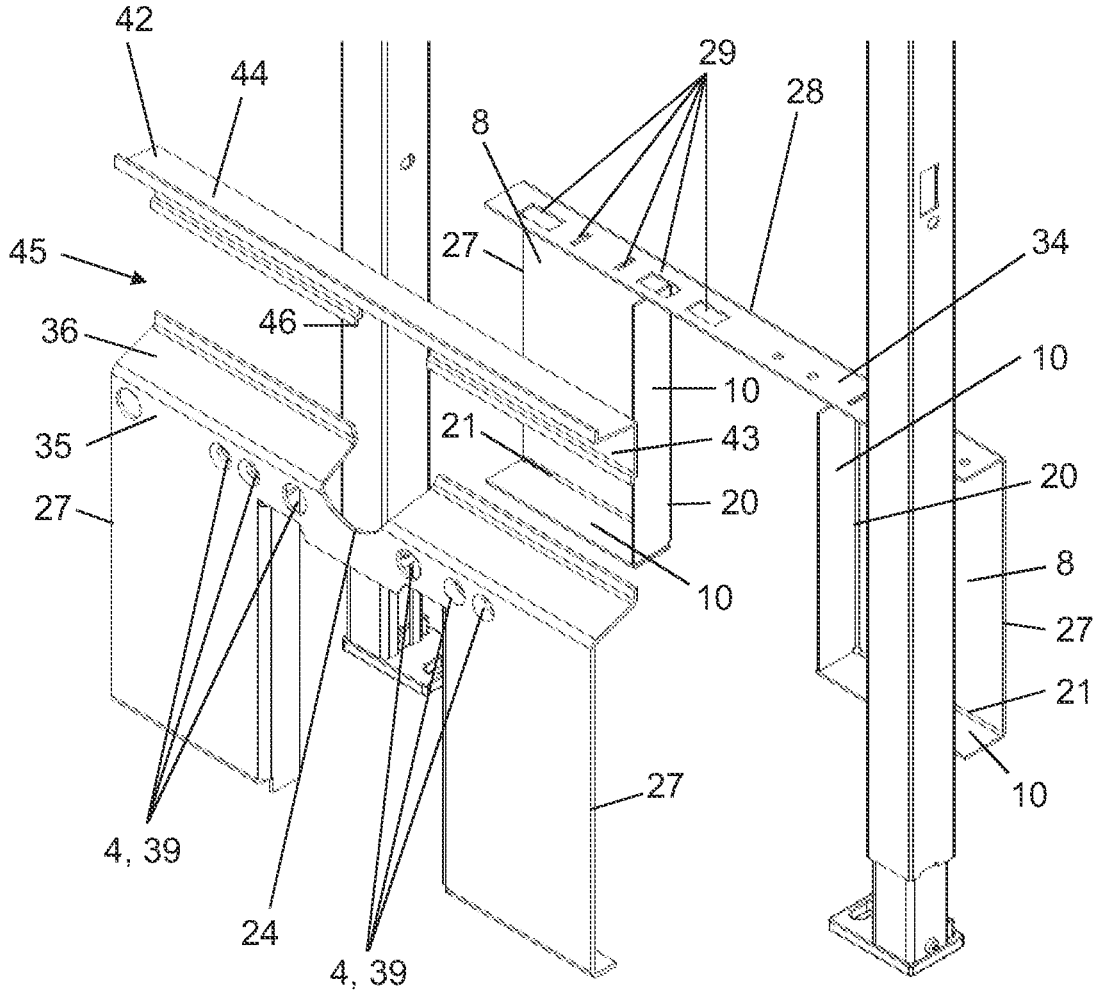
FIG. 8 shows a further exploded illustration of the mounting device according to FIG. 1 with a wall element.
Figure 9:
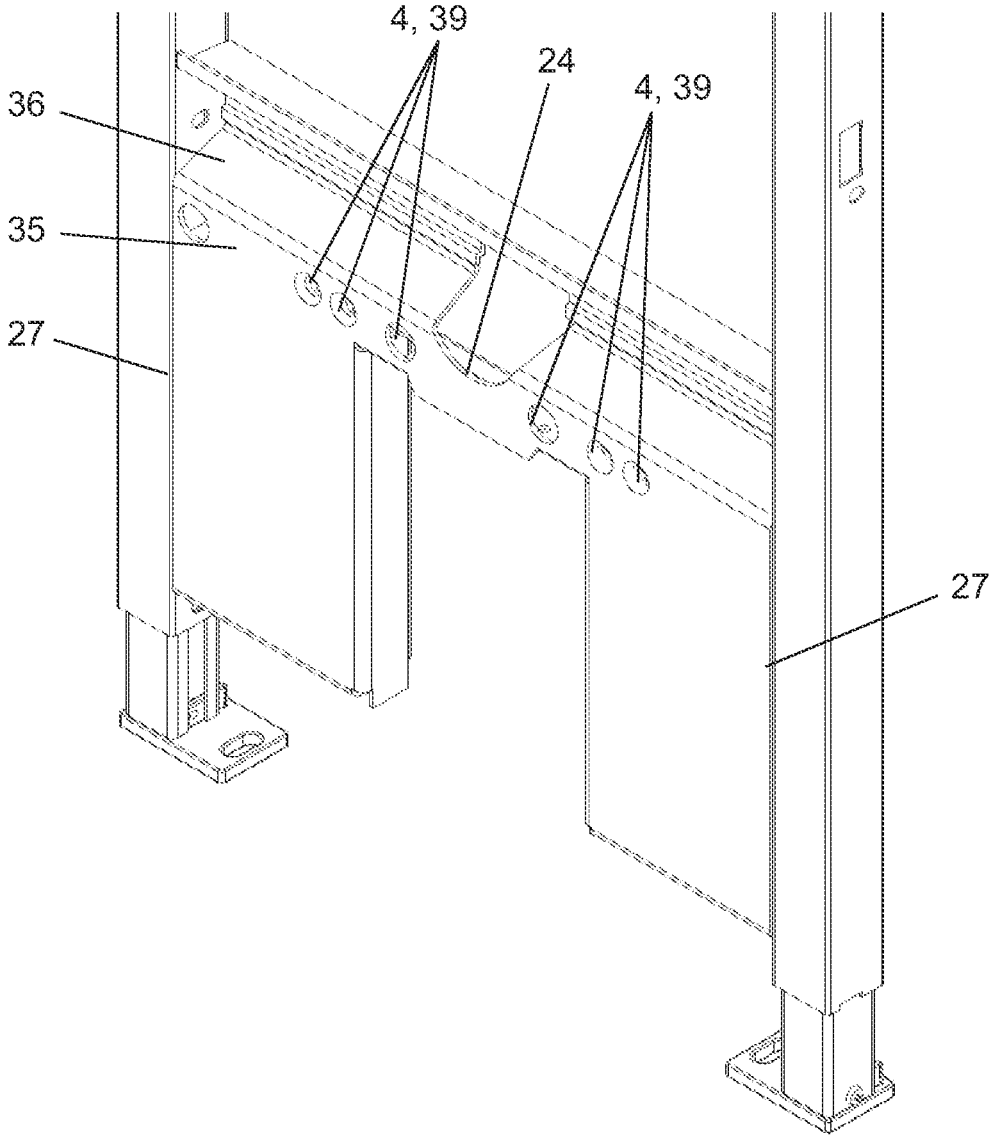
FIG. 9 shows a view of FIG. 8 in the connected state.
Figure 10:
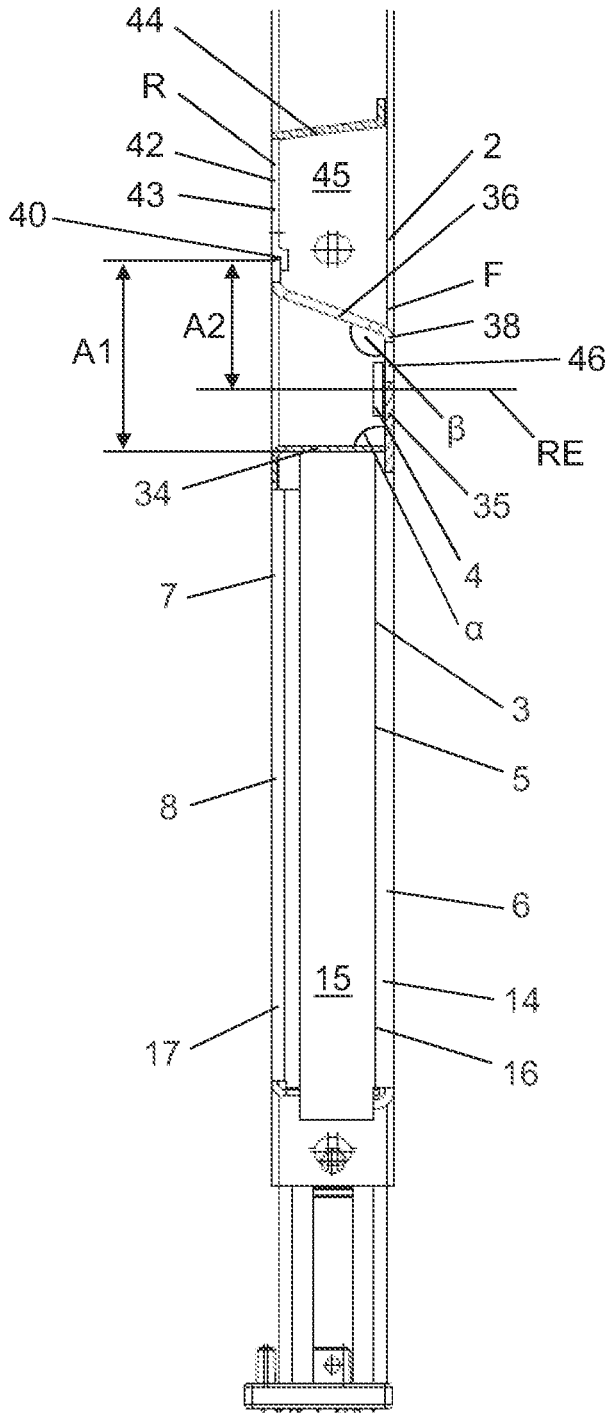
FIG. 10 shows a sectional illustration as in FIG. 7 with the wall element according to FIGS. 8 and 9.
Figure 11:
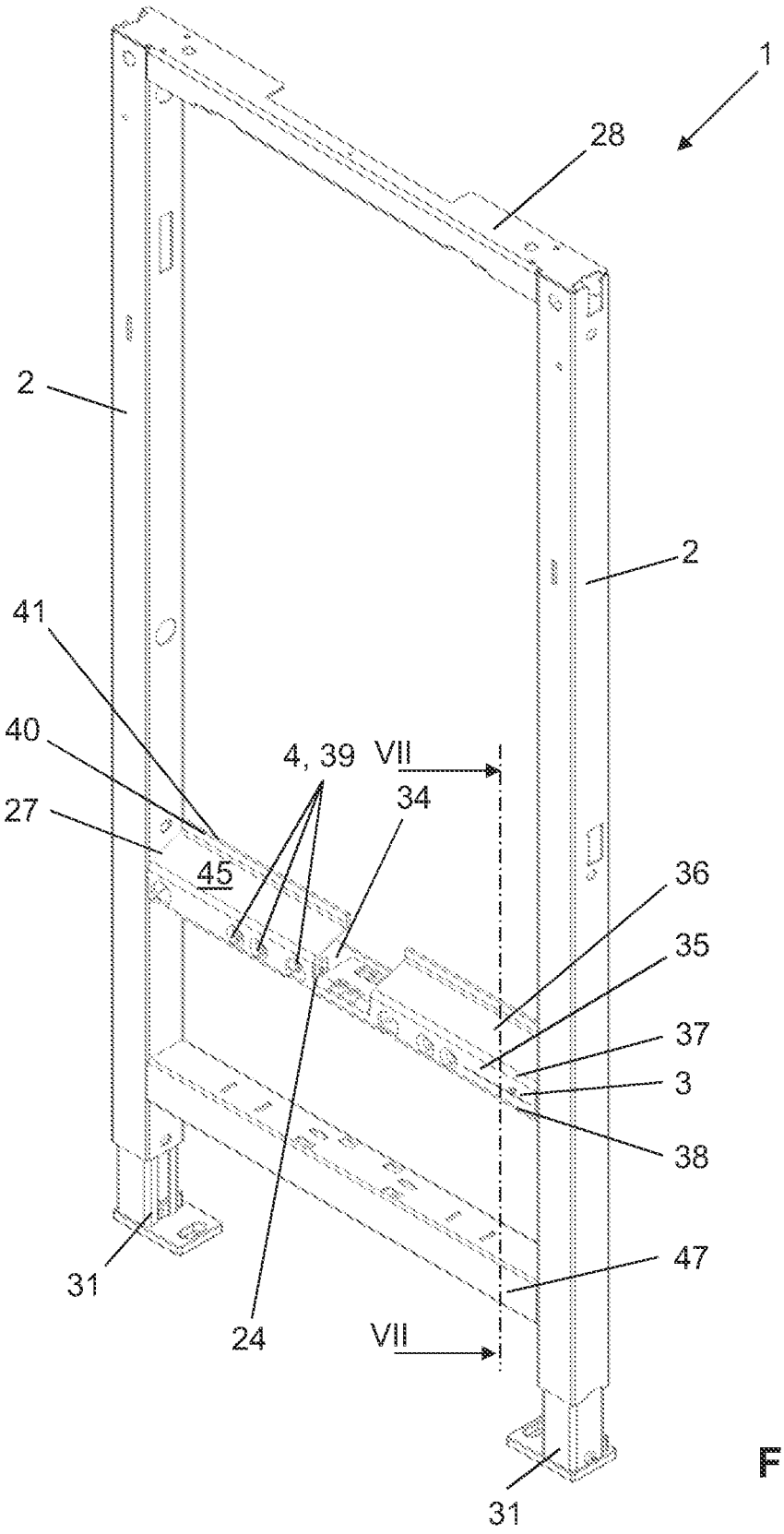
FIG. 11 shows a perspective view of a mounting device according to a further embodiment of the present invention from the front.
Figure 12:
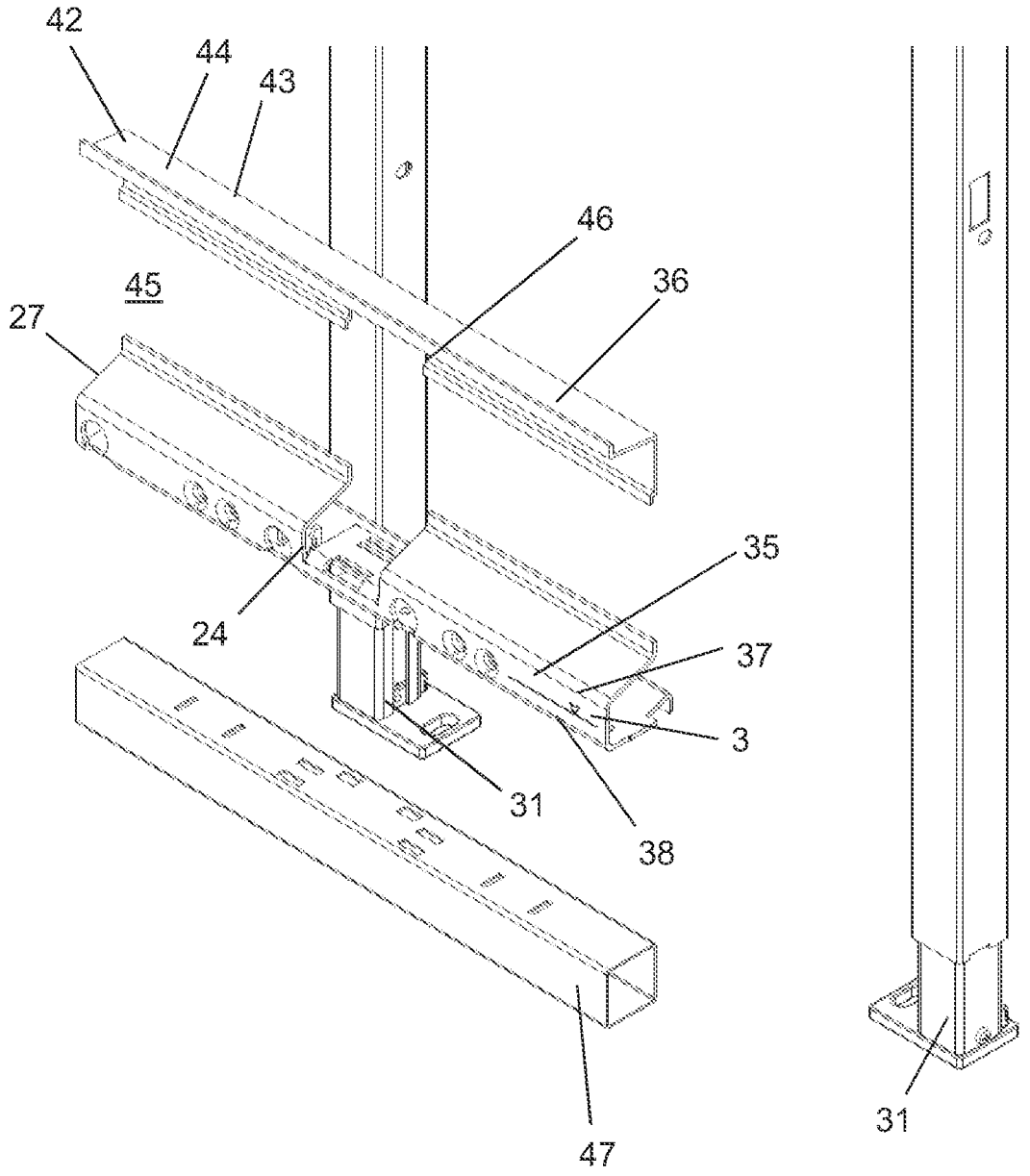
FIG. 12 shows an exploded view of the embodiment of FIG. 11 with a wall element.
Figure 13:
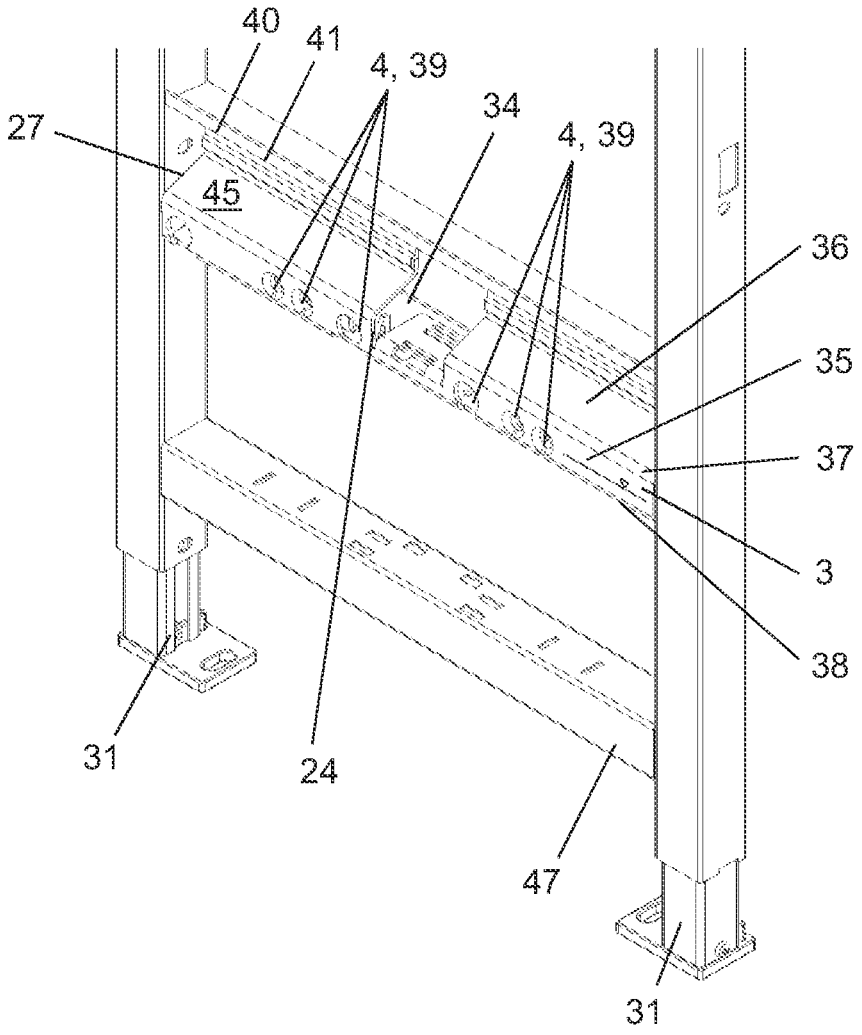
FIG. 13 shows a view of FIG. 12 in the connected state.
Figure 14:
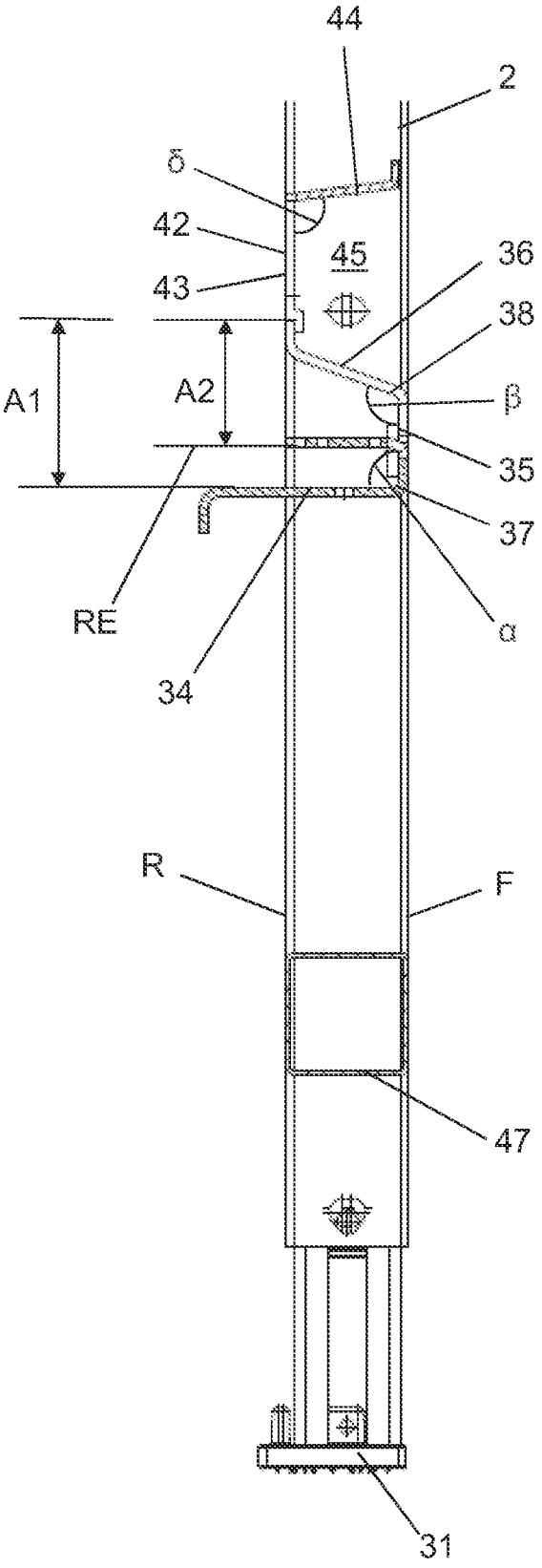
FIG. 14 shows a sectional illustration along section line X-X in FIG. 11.

FIGS. 5 and 6 then show exploded illustrations of the crosspiece element 2 without the supports 2. The front supporting part 5 and the rear supporting part 7 are each illustrated in isolation. FIG. 7 shows a sectional illustration along section line VI in FIG. 2. Further features of the two supporting parts will now be explained with reference to FIGS. 5 to 7.

The front supporting part 5 has a cutout 19 in the supporting wall 6 to provide said recess 18. The cutout 19 is formed by two mutually opposite lateral edges 20. A connecting tab 9 projects at right angles to the supporting wall 6 from each of the lateral edges 20. A connecting tab 9, which projects at right angles to the supporting wall 6, is arranged at each of the lower lateral edges 21 which extend from the end of the lateral edge 20 at the lower end of the front supporting part 5 to the support 2. In the installation position, the lower lateral edge 21 extends substantially in the horizontal direction. The connecting tabs 9 have a length when viewed in the normal direction to the supporting wall 6. The length of the connecting tabs 9 which project from the lateral edge 20 is greater than the length of the connecting tabs 9 which project from the lateral edge 21.

On the upper side, the front supporting part 4 has the front web 35 and the upper web 36 as well as the at least one fastening element 4. In the installation position, the upper web extends toward the rear when viewed from the fastening elements 4. In the embodiment shown, above the cutout 19 and below the interruption 24, the front supporting part 5 has a tab section 30 which projects into the cutout 19 in the region of the fastening elements 4.

The stability of the front supporting part 5 can be further increased by means of the tab section 30.

The rear supporting part 7 has a cutout 19 in the supporting wall 8 to provide said recess 18. The cutout 19 is formed by two mutually opposite lateral edges 20. A connecting tab 10 projects at right angles to the supporting wall 6 from each of the lateral edges 20. A connecting tab 10 which projects at right angles to the rear wall 6 is arranged at each of the lower lateral edges 21 which extend from the end of the lateral edge 20 at the lower end of the rear supporting part 7 to the support 2. In the installation position, the lower lateral edge 21 extends substantially in the horizontal direction. The connecting tabs 10 have a length when viewed in the normal direction to the supporting wall 6. The length of the connecting tabs 10 which project from the lateral edge 20 is equal to the length of the connecting tabs which project from the lateral edge 21.

On the upper side, the rear supporting part 7 comprises the lower web 34. Here, the lower web 34 extends away substantially at right angles from an upper lateral edge 26. In this case, the lateral edge 26 extends from the one support 2 to the other support 2 in the installation position. The lower web 34 serves to reinforce the rear supporting part 7 and furthermore has openings 29 which are used for fastening plumbing appliances or leads or other elements. The lower web 34 is welded laterally to the supports 2.

The lower web 34 of the rear supporting part 7 lies at a distance from the upper web 36 of the front supporting part 5. An installation space 25 is created by this distance.

In the case of both supporting parts 5, 7, the connecting tabs 9, 10 each extend substantially over the entire length of the lateral edges 20, 21.

In the connected state, the connecting tabs 10 of the rear supporting part 7 abut the inner surface 17 of the front supporting part 5 facing the rear supporting part 7, thus defining the distance between the front supporting part 5 and the rear supporting part 7.

In the embodiment shown, the connecting tabs 9 of the front supporting part 5 are shorter in the region of the lower lateral edge 21 than the corresponding connecting tabs 10 of the rear supporting part 7. This is evident from FIG. 7. This shortened design has the advantage that a weld, in particular a weld seam, can be formed on the end face 12 of connecting tab 9 and the surface 13 of connecting tab 10. The weld is shown by the reference sign 11 in FIG. 7. The other connecting tabs 9, 10, which lie to the left and right of the cutout 19, are of the same length on both supporting parts.

In the connected state, the supporting wall 6, the rear wall 8, the connecting tabs 9, 10 and the supports 2 define a hollow body 14 with a cavity 15. In other words, the crosspiece element 3 has a cavity 15. Said weld 11 preferably lies outside the cavity 15.

In the embodiment shown, the mounting device 1 further comprises two supporting feet 31, which are mounted telescopically in the support 2. The supporting feet 31 can be displaced in their position relative to the support 2 and can be locked when the height has been set.

In the embodiment shown, the supports 2 are designed as hollow profiles. In this case, the hollow profiles have a quadrilateral, in each case square cross section.

In the following, details of the embodiment according to FIGS. 11 to 14 will now be described.

In the embodiment according to FIGS. 11 to 14, the crosspiece element 3 is provided as a profile. That is to say that the crosspiece element 3 with the lower web 34, the front web 35 and the upper web 36 is provided by a one-piece profile. In this embodiment, the mounting device 1 has a further crosspiece 47, which, in the installation position, lies below the crosspiece element 3. The further crosspiece 47 provides a supporting wall 6 on which the plumbing appliance can be supported.

In the embodiment shown, the lower web 34 projects beyond the rear plane R.

| LIST OF REFERENCE SIGNS | |
|---|---|
| 1 | mounting device |
| 2 | support |
| 3 | crosspiece element |
| 4 | fastening element |
| 5 | front supporting part |
| 6 | supporting wall |
| 7 | rear supporting part |
| 8 | rear wall |
| 9 | connecting tab |
| 10 | connecting tab |
| 11 | weld |
| 12 | end face |
| 13 | surface |
| 14 | hollow body |
| 15 | cavity |
| 16 | inner surface |
| 17 | inner surface |
| 18 | recess |
| 19 | cutout |
| 20 | lateral edge of cutout |
| 21 | lower lateral edge |
| 24 | interruption |
| 25 | installation space |
| 26 | upper lateral edge |
| 27 | lateral edge |
| 28 | crosspiece |
| 29 | openings |
| 30 | tab section |
| 31 | supporting foot |
| 32 | front surface |
| 33 | rear surface |
| 34 | lower web |
| 35 | front web |
| 36 | upper web |
| 37 | lower edge |
| 38 | upper edge |
| 39 | openings in the front face |
| 40 | free end |
| 41 | end section |
| 42 | wall element |
| 43 | rear wall |
| 44 | upper wall |
| 45 | installation space |
| 46 | aperture |
| 47 | crosspiece |
| α | angle |
| β | angle |
| δ | angle |
| A1, A2 | vertical distance |
| M | central axis |
| V | vertical |
| R | rear plane |
| F | front plane |
| RE | reference plane |

The invention claimed is:

1. A mounting device for fastening at least one plumbing appliance, comprising two supports, which extend at a distance from one another along a central axis, and a crosspiece element, the crosspiece element is arranged between the supports and connects the two supports and has at least one fastening element, wherein the crosspiece element has a lower web, a front web and an upper web, wherein the lower web projects in an angularly inclined manner at an angle from a lower edge of the front web, and the upper web projects in an angularly inclined manner at an angle from an upper edge of the front web, wherein the at least one fastening element is accessible through at least one opening in the front web, wherein the ends of at least one of the webs are each connected to the supports with a welded joint; and wherein the crosspiece element is provided by a front supporting part, having a supporting wall configured to support a plumbing appliance, and a rear supporting part, having a rear wall, wherein the front web and the upper web are formed on the front supporting part and the lower web is formed on the rear supporting part.

2. The mounting device as claimed in claim 1, wherein an upper free end of the upper web, which lies opposite the upper edge of the front web, lies at a vertical distance of 40 to 90 millimeters from the lower web.

3. The mounting device as claimed in claim 1, wherein a reference plane extends at right angles to the central axes of the two supports and centrally through the at least one fastening element, wherein an upper free end of the upper web, which lies opposite the upper edge of the front web, lies at a vertical distance of 35 to 60 millimeters from the reference plane.

4. The mounting device as claimed in claim 1, wherein the angle between the front web and the upper web is in the range of from 100° to 150°, and wherein the angle between the front web and the lower web is between 80° and 100°.

5. The mounting device as claimed in claim 1, wherein the upper web has an end section, the end section is oriented parallel to the front web.

6. The mounting device as claimed in claim 1, wherein the mounting device further comprises a wall element, the wall element is formed separately from the mounting device and is arranged above the crosspiece element.

7. The mounting device as claimed in claim 6, wherein the crosspiece element has an interruption through the front web and the upper web and wherein the wall element has an aperture, the aperture is arranged in such a way that the interruption in the crosspiece element continues upward.

8. The mounting device as claimed in claim 1, wherein the mounting device further comprises a wall element, the wall element is formed separately from the mounting device and is arranged above the crosspiece element, wherein the wall element is in contact with the crosspiece element and wherein the upper web is designed in such a way that it serves to support the wall element.

9. The mounting device as claimed in claim 8, wherein the crosspiece element has an interruption through the front web and the upper web and wherein the wall element has an aperture, the aperture is arranged in such a way that the interruption in the crosspiece element continues upward.

10. The mounting device as claimed in claim 1, wherein the upper web has an end section, the end section is oriented parallel to the front web, wherein the mounting device further comprises a wall element which is formed separately from the mounting device and is arranged above the crosspiece element, and wherein the wall element has a rear wall and an upper wall, wherein the rear wall runs parallel to the central axis in the installation position and wherein the upper wall extends in an angularly inclined manner at an angle to the rear wall, such that an installation space is created between the upper web, the end section, the rear wall and the upper wall.

11. The mounting device as claimed in claim 10, wherein the rear wall has a rear side which lies in a rear plane spanned by the rear surfaces of the supports, and/or wherein the upper wall extends as far as a front plane spanned by the front faces of the supports.

12. The mounting device as claimed in claim 10, wherein the crosspiece element has an interruption through the front web and the upper web and wherein the wall element has an aperture, the aperture is arranged in such a way that the interruption in the crosspiece element continues upward.

13. The mounting device as claimed in claim 1, wherein the upper web has an end section, the end section is oriented parallel to the front web, wherein the mounting device further comprises a wall element, the wall element is formed separately from the mounting device and is arranged above the crosspiece element, wherein the upper web is designed in such a way that it serves to support the wall element, and wherein the wall element has a rear wall and an upper wall, wherein the rear wall runs parallel to the central axis in the installation position and wherein the upper wall extends in an angularly inclined manner at an angle to the rear wall, such that an installation space is created between the upper web, the end section, the rear wall and the upper wall.

14. The mounting device as claimed in claim 13, wherein the rear wall has a rear side which lies in a rear plane spanned by the rear surfaces of the supports, and/or wherein the upper wall extends as far as a front plane spanned by the front faces of the supports.

15. The mounting device as claimed in claim 13, wherein the crosspiece element has an interruption through the front web and the upper web and wherein the wall element has an aperture, the aperture is arranged in such a way that the interruption in the crosspiece element continues upward.

16. The mounting device as claimed in claim 1, wherein the crosspiece element has an interruption through the front web and the upper web.

17. The mounting device as claimed in claim 1, wherein the crosspiece element, with the lower web, the front web and the upper web, is provided by an integral profile, and wherein the mounting device has a further crosspiece, which lies below the crosspiece element in the installation position, wherein the further crosspiece provides a supporting wall configured to support the plumbing appliance.

18. The mounting device as claimed in claim 1, wherein the crosspiece element is provided by a front supporting part, having a supporting wall configured to support a plumbing appliance, and a rear supporting part, having a rear wall, wherein the front web and the upper web are formed on the front supporting part and the lower web is formed on the rear supporting part and wherein the supporting wall extends downward from the at least one fastening element.

19. An arrangement comprising a mounting device and a plumbing appliance said mounting device comprising two supports, which extend at a distance from one another along a central axis, and a crosspiece element, the crosspiece element is arranged between the supports and connects the two supports and has at least one fastening element, wherein the crosspiece element has a lower web, a front web and an upper web, wherein the lower web projects in an angularly inclined manner at an angle from a lower edge of the front web, and the upper web projects in an angularly inclined manner at an angle from an upper edge of the front web, wherein the at least one fastening element is accessible through at least one opening in the front web, wherein the ends of at least one of the webs are each connected to the supports with a welded joint, wherein the crosspiece element is provided by a front supporting part, having a supporting wall configured to support a plumbing appliance, and a rear supporting part, having a rear wall, wherein the front web and the upper web are formed on the front supporting part and the lower web is formed on the rear supporting part, and wherein said plumbing appliance is mounted on the mounting device and having a supporting surface, wherein the supporting surface of the plumbing appliance overlaps parts of the front supporting part, or wherein the supporting surface of the plumbing appliance overlaps parts of the supporting wall of the front supporting part.

20. The mounting device as claimed in claim 6, wherein the wall element is in contact with the crosspiece element.

21. The mounting device as claimed in claim 10, wherein the wall element is in contact with the crosspiece element.

22. The mounting device as claimed in claim 13, wherein the wall element is in contact with the crosspiece element.

23. A mounting device for fastening at least one plumbing appliance, comprising two supports, which extend at a distance from one another along a central axis, and a crosspiece element, the crosspiece element is arranged between the supports and connects the two supports and has at least one fastening element, wherein the crosspiece element has a lower web, a front web and an upper web, wherein the lower web projects in an angularly inclined manner at an angle from a lower edge of the front web, and the upper web projects in an angularly inclined manner at an angle from an upper edge of the front web, wherein the at least one fastening element is accessible through at least one opening in the front web, wherein the ends of at least one of the webs are each connected to the supports with a welded joint;

wherein the mounting device further comprises a wall element which is formed separately from the mounting device, wherein the wall element is in contact with the crosspiece element; and the wall element has a rear wall and an upper wall, wherein the upper wall extends in an angularly inclined manner at an angle to the rear wall, such that an installation space is created between the upper web, the end section, the rear wall and the upper wall.

24. The mounting device as claimed in claim 23, wherein an upper free end of the upper web, which lies opposite the upper edge of the front web, lies at a vertical distance of 40 to 90 millimeters from the lower web.

25. The mounting device as claimed in claim 23, wherein a reference plane extends at right angles to the central axes of the two supports and centrally through the at least one fastening element, wherein an upper free end of the upper web, which lies opposite the upper edge of the front web, lies at a vertical distance of 35 to 60 millimeters from the reference plane.

26. The mounting device as claimed in claim 23, wherein the angle between the front web and the upper web is in the range of from 100° to 150°, and wherein the angle between the front web and the lower web is between 80° and 100° or at 90°.

27. The mounting device as claimed in claim 23, wherein the upper web has an end section which is oriented parallel to the front web.

28. The mounting device as claimed in claim 23, wherein that the wall element is arranged above the crosspiece element.

29. The mounting device as claimed in claim 23, wherein the upper web is designed in such a way that it serves to support the wall element.

30. The mounting device as claimed in claim 23, wherein the rear wall runs parallel to the central axis in the installation position.

31. The mounting device as claimed in claim 23, wherein the rear wall has a rear side which lies in a rear plane spanned by the rear surfaces of the supports, and/or wherein the upper wall extends as far as a front plane spanned by the front faces of the supports.

32. The mounting device as claimed in claim 23, wherein the crosspiece element has an interruption through the front web and the upper web.

33. The mounting device as claimed in claim 23, wherein the crosspiece element has an interruption through the front web and the upper web and wherein the wall element has an aperture arranged in such a way that the interruption in the crosspiece element continues upward.

34. The mounting device as claimed in claim 23, wherein the crosspiece element, with the lower web, the front web and the upper web, is provided by an integral profile, and wherein the mounting device has a further crosspiece, which lies below the crosspiece element in the installation position, wherein the further crosspiece provides a supporting wall configured to support the plumbing appliance.

35. The mounting device as claimed in claim 23, wherein the crosspiece element is provided by a front supporting part, having a supporting wall configured to support a plumbing appliance, and a rear supporting part, having a rear wall, wherein the front web and the upper web are formed on the front supporting part and the lower web is formed on the rear supporting part.

36. The mounting device as claimed in claim 23, wherein the crosspiece element is provided by a front supporting part, having a supporting wall configured to support a plumbing appliance, and a rear supporting part, having a rear wall, wherein the front web and the upper web are formed on the front supporting part and the lower web is formed on the rear supporting part, and wherein the supporting wall extends downward from the at least one fastening element.

* * * * *